US009174352B2

(12) United States Patent
Repac

(10) Patent No.: US 9,174,352 B2
(45) Date of Patent: Nov. 3, 2015

(54) DEVICE FOR CUTTING FOOD AND MULTI-FUNCTIONAL DEVICE FOR THE KITCHEN

(75) Inventor: Cedomir Repac, Brechen (DE)

(73) Assignee: GENIUS GMBH, Limburg (DE)

( * ) Notice: Subject to any disclaimer, the term of this patent is extended or adjusted under 35 U.S.C. 154(b) by 119 days.

(21) Appl. No.: 13/058,216

(22) PCT Filed: May 28, 2010

(86) PCT No.: PCT/EP2010/003250
§ 371 (c)(1),
(2), (4) Date: Mar. 2, 2011

(87) PCT Pub. No.: WO2010/136210
PCT Pub. Date: Dec. 2, 2010

(65) Prior Publication Data

US 2012/0055303 A1 Mar. 8, 2012

(30) Foreign Application Priority Data

May 29, 2009 (DE) ..... 10 2009 023 167

(51) Int. Cl.
*B26D 7/00* (2006.01)
*B26D 7/02* (2006.01)
(Continued)

(52) U.S. Cl.
CPC *B26D 3/185* (2013.01); *B26D 3/26* (2013.01); *B26D 7/1818* (2013.01); *B26D 1/34* (2013.01); *Y10T 83/222* (2015.04)

(58) Field of Classification Search
CPC ..... A47J 43/25; B26D 7/00; B26D 3/185; B26D 7/1818; B26D 3/26; B26D 1/34; Y10T 83/222
USPC ..... 83/167, 466.1, 597, 856–858, 411.1, 83/648; 30/299, 302, 114; 99/513, 596
See application file for complete search history.

(56) References Cited

U.S. PATENT DOCUMENTS 1,113,990 A * 10/1914 Henderson ..... 99/583
1,349,180 A * 8/1920 Yeakel ..... 83/584
(Continued)

FOREIGN PATENT DOCUMENTS

DE 8525144 U1 3/1986
DE 8525144 U1 3/1986
(Continued)

OTHER PUBLICATIONS

European Patent Office, International Search Report in International Patent Application No. PCT/EP2010/003250 (Dec. 15, 2010).
(Continued)

*Primary Examiner* — Ghassem Alie
*Assistant Examiner* — Bharat C Patel
(74) *Attorney, Agent, or Firm* — Leydig, Voit & Mayer, Ltd.

(57) ABSTRACT

A device for cutting food, such as fruit and vegetables, comprising a cutting part having several blades and an actuation part, the parts being mounted, so that they can pivot counter to each other by means of a pivot bearing, and the actuation part is pressed against the cutting part in order to cut the food to be cut, and a multifunctional kitchen device comprising this device. The device may also have a cover part for that is affixed onto a collecting container for the cut food, whereby the lid part has an opening with a passage for the cut food. A pivot bearing can be accommodated in the opening.

21 Claims, 8 Drawing Sheets

(51) Int. Cl.

| | |
|---|---|
| ***B26D 5/08*** | (2006.01) |
| ***B26B 3/00*** | (2006.01) |
| ***A23N 1/00*** | (2006.01) |
| ***B04B 5/10*** | (2006.01) |
| ***B26D 3/18*** | (2006.01) |
| ***B26D 3/26*** | (2006.01) |
| ***B26D 7/18*** | (2006.01) |
| *B26D 1/34* | (2006.01) |

(56) References Cited

U.S. PATENT DOCUMENTS

| | | | | | |
|---|---|---|---|---|---|
| 1,512,055 | A | | 10/1924 | Rosenthal | |
| 1,599,346 | A | | 9/1926 | Purkey | |
| 1,748,997 | A | * | 3/1930 | Rentos | 83/407 |
| 2,004,858 | A | * | 6/1935 | Farabough | 83/167 |
| 2,099,978 | A | * | 11/1937 | Hess | 99/509 |
| 2,166,624 | A | * | 7/1939 | Cohn et al. | 83/466.1 |
| 2,245,978 | A | * | 6/1941 | Hyland | 83/553 |
| 2,466,121 | A | * | 4/1949 | Norman | 83/167 |
| 2,511,909 | A | * | 6/1950 | Forman | 241/84.4 |
| 2,615,486 | A | | 10/1952 | Marcus | |
| 2,661,039 | A | * | 12/1953 | Davis et al. | 99/513 |
| 2,714,908 | A | * | 8/1955 | Carmack | 241/95 |
| 2,720,234 | A | * | 10/1955 | Fett | 241/273.1 |
| 3,145,743 | A | * | 8/1964 | Cronheim | 83/466.1 |
| 3,605,839 | A | * | 9/1971 | Gerson | 83/425.3 |
| 3,774,490 | A | * | 11/1973 | Gerson | 83/425.3 |
| 3,807,266 | A | * | 4/1974 | Camp | 83/404.4 |
| 3,948,132 | A | * | 4/1976 | Camp | 83/425.3 |
| 4,040,319 | A | * | 8/1977 | Taniyama | 83/425.3 |
| 4,044,663 | A | * | 8/1977 | Straw | 99/577 |
| 4,055,308 | A | * | 10/1977 | Ackeret | 241/100 |
| 4,062,260 | A | * | 12/1977 | Steinhogl | 83/404.3 |
| 4,137,807 | A | * | 2/1979 | Schaumberg | 83/599 |
| 4,145,941 | A | * | 3/1979 | Davis | 83/167 |
| 4,212,431 | A | * | 7/1980 | Doyel | 241/100 |
| 4,346,634 | A | * | 8/1982 | Jones | 83/431 |
| 4,383,365 | A | * | 5/1983 | Metzigian | 30/114 |
| 4,733,589 | A | * | 3/1988 | Wolff | 83/858 |
| 5,513,562 | A | * | 5/1996 | Moor | 100/112 |
| 5,692,424 | A | * | 12/1997 | Wallace | 83/167 |
| 5,749,145 | A | * | 5/1998 | Baukloh | 30/114 |
| 6,148,704 | A | * | 11/2000 | Lewis | 83/167 |
| 6,401,605 | B1 | | 6/2002 | Repac et al. | |
| 6,558,244 | B1 | | 5/2003 | Nedelka | |
| D485,328 | S | | 1/2004 | Jastrzembski | |
| 6,802,149 | B1 | * | 10/2004 | Albanese et al. | 43/4 |
| 6,805,032 | B2 | | 10/2004 | Engdahl | |
| D507,159 | S | | 7/2005 | Lee | |
| 7,000,535 | B2 | * | 2/2006 | Harrison-Griffin et al. | 100/126 |
| 7,191,691 | B2 | * | 3/2007 | Kaposi | 83/167 |
| D545,642 | S | | 7/2007 | Wong | |
| D546,638 | S | | 7/2007 | Kaposi | |
| 7,296,762 | B2 | * | 11/2007 | Dorion | 241/169 |
| 7,444,909 | B2 | * | 11/2008 | Repac et al. | 83/167 |
| D618,517 | S | | 6/2010 | Wong | |
| 2004/0055437 | A1 | | 3/2004 | Engdahl | |
| 2005/0229405 | A1 | | 10/2005 | Endres et al. | |
| 2006/0090352 | A1 | | 5/2006 | Kaposi | |
| 2007/0215729 | A1 | * | 9/2007 | Wong et al. | 241/94 |
| 2009/0019705 | A1 | | 1/2009 | Aby-Eva et al. | |
| 2009/0114104 | A1 | | 5/2009 | Sawhney et al. | |
| 2010/0031830 | A1 | | 2/2010 | Engdahl et al. | |
| 2010/0175569 | A1 | | 7/2010 | Aby-Eva et al. | |

FOREIGN PATENT DOCUMENTS

| | | | |
|---|---|---|---|
| DE | 3719649 | A1 | 1/1988 |
| DE | 21 2005 000 048 | U1 | 5/2007 |
| DE | 212005000048 | U1 | 5/2007 |
| DE | 102006017322 | A1 | 10/2007 |
| DE | 001631847-0001 | | 11/2009 |
| DE | 402009005783-0001 | | 2/2010 |
| DE | 10 2009023167 | A1 | 12/2010 |
| DE | 19948168 | C1 | 11/2011 |
| EA | EC000503453-0001 | | 5/2006 |
| FR | 747115 | A | 6/1933 |
| FR | 747115 | A | 6/1933 |
| WO | WO-02/064331 | A1 | 8/2002 |
| WO | WO-2005090029 | A1 | 9/2005 |
| WO | WO-2006049639 | A1 | 5/2006 |
| WO | WO 2008097178 | A1 | 8/2008 |
| WO | WO 2009012014 | A1 | 1/2009 |
| WO | WO-2009/044274 | A2 | 4/2009 |
| WO | WO-2009/058987 | A1 | 5/2009 |

OTHER PUBLICATIONS

European Patent Office, International Search Report in International Patent Application No. PCT/EP2010/003251 (Dec. 12, 2010).

* cited by examiner

DEVICE FOR CUTTING FOOD AND MULTI-FUNCTIONAL DEVICE FOR THE KITCHEN

CROSS-REFERENCE TO RELATED APPLICATIONS

This application is a national stage application (under 35 U.S.C. §371) of PCT/EP2010/003250, filed May 28, 2010, which claims benefit of German application 10 2009 023 167.6, filed May 29, 2009.

TECHNICAL BACKGROUND AND STATE OF THE ART

The invention relates to a device for cutting food such as fruit and vegetables, comprising a cutting part having several blades and an actuating part, said parts being mounted so that they can pivot counter to each other by means of a pivot bearing, and the actuating part is pressed against the cutting part in order to cut the food to be cut, and comprising a lid part that is affixed onto a collecting container for the cut food, whereby the lid part has an opening with a passage for the cut food. The invention also relates to a multi-functional device for the kitchen.

Devices for cutting fruit and vegetables are generally known. They normally have a cutting part fitted with several blades and a counterpart, said parts being mounted so that they can pivot counter to each other. The food to be cut is located between the cutting part and the counterpart. In order for the food to be cut, the cutting part is pressed against the counterpart or conversely, the counterpart is pressed against the cutting part. The counterpart usually has a plunger element that, during the cutting procedure, serves to push the food to be cut through the cutting part. For this purpose, the plunger element normally has indentations into which the blades of the cutting part are lowered during the cutting procedure. A high cutting force can be generated with cutting devices that function according to this pivoting principle since, depending on the design, either the cutting part or the counterpart functions like a lever. For this reason, cutting devices that function according to the pivoting principle are particularly well-suited for cutting hard food such as, for example, carrots or potatoes.

It has been found in actual practice that the cutting devices that function according to the pivoting principle have a tendency to tip over sideways during the cutting procedure, especially when the food to be cut is hard, as a result of which a high cutting force has to be applied. This tendency to tip over sideways is especially promoted by the elongated shape of the cutting devices due to the their pivoting functional parts that function like a lever, as a result of which the cutting devices often exhibit an inadequate footprint in the crosswise direction. Owing to the tendency to tip over, the prior-art cutting devices that function according to the pivoting principle are not always easy to handle.

French patent of invention FR 747 115 A discloses a device for cutting potatoes. The device has a cutting part fitted with blades and an actuating part, said parts being mounted so that they can pivot counter to each other. In order for the food to be cut, the actuating part is pressed against the cutting part and then, when it is in the pivoted position, it comes to rest on the cutting part. The spaces between the blades of the cutting part form a passage for the cut food that is pressed down through the blades during the cutting procedure. The cut food is captured in a collecting container on which the cutting part rests. The collecting container is open towards the top and essentially encompasses the area of the blades. The cutting part projects over the collecting container, at least with its one end that is pivotably connected to the actuating part. It is also possible for the opposite end of the cutting part to project over the collecting container. Due to these sections of the cutting part that extend over the collecting container, the prior-art cutting device has a tendency to tip over sideways during the cutting procedure, especially when the food to be cut is hard, since a high cutting force has to be applied for this purpose.

German utility model DE 21 2005 000 048 U1 discloses another device for cutting food. This device has a cutting part fitted with blades and an actuating part that is pressed against the cutting part in order to cut the food that is to be cut. The cutting part is an integral part of a lid that is placed onto a container that collects the cut food. In this cutting device, the actuating part and the collecting container are mounted so that they can pivot counter to each other with the cutting part interposed between them. Towards this end, there are pivot pins on the sides of the collecting container and they extend into corresponding receptacles on the actuating part, thus forming a hinge. The actuating part also has a surrounding side wall facing downwards that extends laterally over the lid when the cutting device is in the folded state. The collecting container is configured as a cube, whereby the longitudinal axes of the lid, the cutting part and the actuating part lie in the lengthwise direction of the collecting container. As a result, this prior-art cutting device likewise has a tendency to tip over sideways during the cutting procedure.

SUMMARY OF THE INVENTION

The invention has the objective of putting forward a device for cutting food such as fruit and vegetables, said device having the above-mentioned features and being easier to handle than the cutting devices known so far that function according to the pivoting principle.

The device according to an embodiment of the invention for cutting food such as, for example, fruit and vegetables has a cutting part fitted with several blades and an actuating part for actuating the cutting device. The cutting part and the actuating part are mounted so that they can pivot counter to each other by means of a pivot bearing, whereby the actuating part is pressed against the cutting part in order to cut the food that is to be cut. The cutting device according to this embodiment of the invention preferably has a plunger plate that pushes the food to be cut all the way through the cutting part. Preferably, the plunger plate should be arranged on the actuating part at a distance from the pivot axis of the pivot bearing so that, when the actuating part is pivoted, the plunger plate reliably pushes the food to be cut all the way through the cutting part.

Moreover, the cutting device according to an embodiment of the invention has a lid part that serves to affix the cutting device onto a collecting container for the cut food. The lid part has an opening with a passage for the cut food.

According to an aspect of the invention, the pivot bearing is accommodated in the opening of the lid part.

Thanks to this measure, it is possible to create a cutting device having a large base since the pivot bearing, unlike in the cutting devices known so far, is situated in or inside the opening of the lid part. The lid part can be dimensioned to be considerably larger than the actuating part, as a result of which it provides a large contact surface area for the collecting container. This reliably prevents any tendency on the part of the cutting device to tip over during the cutting procedure. All in all, this translates into improved handling, particularly during the cutting procedure.

It lends itself for the pivot bearing, especially for the pivot axis of the pivot bearing, to be arranged so as to be recessed with respect to the top of the lid part. As a result, the entire actuating part can be lowered into the opening, so that, when the actuating part is in the pivoted-down position, it is at least partly integrated into the lid part and projects upwards only slightly, or else not at all, from the lid part.

According to an embodiment of the invention, it is provided that the pivot bearing is arranged on at least one side wall adjacent to the opening. In this manner, the pivot bearing can easily be positioned in the opening of the lid part.

According to another embodiment of the invention, it can be provided that the pivot bearing is formed by at least one hinge. The hinge can be formed, for instance, by a pivot pin arranged on the at least one side wall of the opening and by a receptacle arranged on the actuating part. This can be easily achieved from the standpoint of production technology. Here, it is preferable for such a hinge to be formed on each of the two opposite side walls.

According to a refinement of the invention or to an independent idea of the invention, means are provided that serve to reinforce the lid part in the vicinity of the opening. This increases the stiffness of the lid part, especially in the area weakened by the opening. As a consequence, deformation of the lid part during the cutting procedure can be prevented or at least reduced to such an extent as to ensure that the food can be cut without problems, injuries or damage to the cutting device. The cutting device according to the invention is thus easy to handle, especially when the food to be cut is hard. The container that serves to collect the cut food and that can be coupled to the lid part also contributes to the ease of handling.

According to an embodiment of the invention, it is provided that the reinforcement means are formed by at least one reinforcement part that at least partially spans the opening. This reliably counteracts deformation in the area of the edge of the opening during the cutting procedure.

According to another embodiment of the invention, it is provided that the reinforcement part is arranged between the pivot bearing and the passage for the cut food. As a result, the reinforcement part has a reinforcing or stiffening effect precisely where the lid part is especially weakened because of its opening. This measure very reliably prevents any deformations of the lid part during the cutting procedure.

According to another embodiment of the invention, it is provided that the reinforcement part has an upright web section. This translates into a particularly torsion-resistant reinforcement part.

The web section preferably has lateral insertion slits into each of which a side wall of the actuating part is lowered during the pivoting motion. This ensures that, in spite of the web-like reinforcement part, the actuating part can be pivoted completely counter to the cutting part, thus ensuring that the food is reliably cut all the way through.

According to yet another embodiment of the invention, it is provided that the reinforcement part is configured as a limiter against a movement of the cutting part or of the blades in the direction of the pivot bearing. As a result, the reinforcement part acquires a dual function; on the one hand, it serves to reinforce the lid part in the area of its opening and, on the other hand, it serves as a limiting part for the blades. As a result, additional components are not needed in order to limit the movement of the blades.

It lends itself for the reinforcement part to be formed onto the lid part or onto the cutting part, especially onto a section of the lid part and/or of the cutting part. As a result, the reinforcement of the lid part or of the cutting part can be realized in a particularly easy and cost-effective manner since there is no need for separate components.

In addition to or as an alternative to the reinforcement part, it can be provided according to another embodiment of the invention that the reinforcement means are formed by the side walls of the lid part which form a depression and which at least partially surround the opening of the lid part. The side walls constitute an additional measure to stiffen or reinforce the lid part, especially in the area of its opening, in order to prevent deformation of the lid part due to the huge force that is exerted during the cutting procedure, thus ensuring that the food is reliably cut all the way through.

According to an embodiment of the invention, it is provided that the actuating part is essentially lowered into the opening of the lid part during the pivoting procedure. This constitutes another measure to ensure that the food is reliably cut all the way through. After all, when the actuating part is lowered into the opening, this creates a positive fit between the actuating part and the lid part, so that the plunger plate of the actuating part cannot deflect sideways when it is in the lowered position, even when high cutting forces are exerted onto the actuating part and/or onto the lid part.

Here, it lends itself that, in the closed or folded position, the actuating part is essentially lowered into the opening. As a result, the actuating part has a surface that is essentially smooth or at least not substantially raised vis-à-vis the lid part, so that the top of the lid part has a very attractive appearance. Naturally, the cutting device is designed to be particularly compact in its closed position.

It also lends itself for the blades to be arranged with respect to the top of the lid part so as to be recessed towards the interior of the collecting container. This creates a collecting container for the food to be cut, preventing food from spilling during the cutting procedure. This also prevents juice from the cut fruit or cut vegetables from dripping uncontrolled along the top of the lid part.

According to another embodiment of the invention, it is provided that the cutting part is formed by the lid part. As a result, the cutting device can be created very easily and inexpensively since the lid part and the cutting part are formed by a single component. In this context, the cutting part is preferably shaped onto the lid part.

Preferably, the blades should be secured in a detachable or loose frame arranged on the cutting part. In this manner, the blades can be exchanged for other blades very easily.

This can be done particularly easily if, according to another embodiment of the invention, the depression of the lid part created by the side walls forms a contact surface for the blade frame. As a result, without any extra aids, the blade frame can be affixed in a defined position onto the lid part or onto the cutting part and is thus ready to be used for the cutting operation. Here, the reinforcement part preferably serves as one of the parts of the depression that forms the contact surface.

According to another embodiment of the invention, it is provided that the blades are configured as a cutting grid. This translates into a very stable cutting structure that prevents deformation of the blades, even when the food to be cut is very hard.

Preferably, the blades are in the form of knives. This likewise accounts for very stable and stiff blades that allow especially hard food to be reliably cut all the way through.

In order to ensure that the food will be cut all the way through, according to a particularly advantageous embodiment of the invention, it is provided that the plunger plate has indentations that correspond to the blades.

Here, the clear depth of the indentations should preferably be greater than the height of the blades. Consequently, during the cutting procedure, the indentations of the plunger plate are lowered into the blades to such a depth that, in the folded position of the actuating part or in the contact position of the actuating part, the free ends of the projections of the plunger plate extend beyond the blades. In this manner, it is ensured that the food to be cut is reliably pushed down through the blades during the cutting procedure.

According to a refinement of the invention or to an independent idea of the invention, a manually actuatable mechanism is provided by means of which at least one cleaning part can be moved along the plunger plate all the way to an end position in the vicinity of the free end of the plunger plate.

Thanks to this measure, cut food residues can be removed from the plunger plate, especially from the indentations of the plunger plate, by sliding the cleaning part. Therefore, the cleaning part makes it possible to clean the plunger plate in a simple manner in that all the mechanism merely has to be actuated. Consequently, manual actuation of the mechanism allows the plunger plate to be freed from cut food residues by means of a simple handling procedure. It is essentially prevented that any of these cut food residues are left behind since the cleaning part can be moved into the area of the free end of the plunger plate, especially up to the free end or all the way to the free end of the plunger plate. The term "free end of the plunger plate" as set forth in the invention refers to the end of the plunger plate that faces the cutting part during the pivoting motion of the actuating part.

The manually actuatable mechanism is preferably mechanically coupled to the cleaning part; in particular, the cleaning part is secured on a functional part of the mechanism and/or on the actuating part so that it cannot come off.

It lends itself for the at least one cleaning part to be movable on the plunger plate. This allows cut food residues to be cleaned out of the cutting device very effectively since the cut food residues, especially the cut food residues present in the indentations, are completely carried along by the cleaning part and transported up to the free end of the plunger plate or all the way to the free end of the plunger plate as a result of the sliding movement of the cleaning part. Within the scope of the invention, the term "movement of the cleaning part on the plunger plate" is to be understood to the effect that the cleaning part comes into contact, or can come into contact, with the plunger plate and that, at the maximum, only a slight distance is left between the cleaning part and the plunger plate, especially a small gap between the cleaning part and the plunger plate.

According to an embodiment of the invention, it is provided that, due to the actuation of the mechanism or during the actuation of the mechanism, the cleaning part can be moved into the end position. Thus, a simple actuation puts the mechanism into motion and moves the cleaning part.

Preferably, after the mechanism has been actuated, the cleaning part should automatically return to its initial position. As a result, the cleaning of the plunger plate is reduced to just one single actuation, namely, moving the cleaning part from its initial position into at least one intermediate position or into the end position.

It lends itself to use the area of the bottom of the plunger plate as the initial position for the cleaning part. The term "bottom of the plunger plate" is preferably to be understood as the area where the plunger plate is arranged on, especially shaped onto, the actuating part. Preferably, the area of the bottom of the indentations can also be understood as the bottom of the plunger plate. In the initial position, the cleaning part should not hinder the proper functioning of the plunger plate, namely, the lowering of the blades into the corresponding indentations of the plunger plate, thus ensuring that the food is cut all the way through. For this purpose, in the initial position, the cleaning part can be brought into contact, especially under pre-tensioning, with the bottom of the indentations and/or with the bottom of the plunger plate.

It lends itself for the mechanism to be actuatable from the top of the pivotable actuating part. As a result, the mechanism can be configured in a very simple manner since the mechanism is in the immediate vicinity of the plunger plate that is to be cleaned. This also makes the actuating element easily accessible from the outside.

Preferably, the manually actuatable mechanism is configured in such a way that pressing the actuating part of the mechanism causes the cleaning part to move.

According to an advantageous embodiment of the invention, it is provided that the mechanism has an actuating element that, when actuated, moves the cleaning part counter to the force of at least one spring element. The movement of the cleaning part out of its initial position towards the free end of the plunger plate and the automatic return of the cleaning part to its initial position can thus be achieved in a simple manner. Here, the cleaning part is pulled back or pushed back into its initial position by the pre-tensioning of the at least one spring element. Preferably, the spring element here is a tension spring that is pre-tensioned when the cleaning part moves out of its initial position.

Here, it lends itself for the actuating element to be coupled to a pressure part by means of which the actuating force exerted by the actuating element is transmitted to the cleaning part via several pressure elements that are distributed on the cleaning part and act upon it. As a result, the actuating force can be uniformly distributed from the one actuating part to the surface of the cleaning part, so that tilting or tipping of the cleaning part vis-à-vis the plunger plate is prevented.

According to another embodiment of the invention, it is provided that the cleaning part is configured as a grid that corresponds to the indentations of the plunger plate. Consequently, even cut food residues present between the indentations of the plunger plate can be removed from it by the movement of the cleaning part.

According to another embodiment of the invention, it is provided that the cutting part and the actuating part are detachably connected to each other. This measure is aimed at further improving the handling of the cutting device since, for example, it facilitates the cleaning of the entire device. This means that the actuating part can be cleaned separately from the other functional parts of the cutting device.

According to a refinement of the invention or to an independent idea of the invention, it is provided that the lid part has a width that is approximately 1.5 to 3.5 times, preferably about 2 times, the width of the actuating part. As a result, the lid part has enough material on both sides of the opening that accommodates the actuating part to adequately withstand the forces exerted during the cutting procedure. The term "width of the lid part" refers to the extension in the same direction as the width of the actuating part, whereby the width of the actuating part is the extension crosswise to the actuating part that functions as a lever.

According to an embodiment of the invention, it is provided that the lid part is configured to be essentially circular. This allows the lid part to be combined with collecting containers for the cut food that are on hand in households anyway such as, for example, bowls, which usually have essentially circular openings or a circular rim along the opening. Such collecting containers can be familiar bowls of the type often already on hand in households and kitchens. In the circular lid part, the width of the lid part corresponds to its diameter.

It also lends itself for the lid part to be detachably secured on the collecting container. This allows the lid part to be easily removed from the collecting container and, by the same token, the lid part can be affixed firmly onto the collecting container, for example, while the food in being cut.

Preferably, the lid part should be detachably secured on the collecting container by means of a bayonet connection, a screwed connection, a latching connection, a clip connection, a clasping connection and the like. Such fastening means are easy to produce with little effort.

A multi-functional device for the kitchen may include a device for cutting food of the above-mentioned type, and with a collecting container, for instance, in the form of a bowl, onto which the lid part of the device can be placed.

According to a refinement, the multi-functional device has an additional implement for processing fruit and vegetables which, instead of the device for cutting food of the above-mentioned type, can optionally be placed with its lid part onto the collecting container. Such an additional food-processing implement can be a salad spinner with which the salad is dried prior to being cut with the cutting device. Such an additional food-processing implement can also be a vegetable slicer that is integrated into a lid part.

According to a refinement of the multi-functional device, it is provided that the lid part is detachably secured on the collecting container. As a result, the various food-processing implements can be exchanged simply and easily as desired.

In order to ensure that the food-processing implement in question fits securely on the collecting container without wobbling, the front face of the rim along the opening of the collecting container should preferably make contact with at least sections of the lid part of the food-processing implement.

Preferably, the rim along the opening of the collecting container should also at least partially encompass a collar of the lid part that projects towards the interior of the collecting container. This allows the lid part that is placed onto the collecting container to be joined to the collecting container in a form-fitting manner, so that the lid part is prevented from slipping sideways off of the collecting container, for instance, when the food is being cut.

According to an advantageous embodiment of the invention, it is provided for the collecting container to be transparent. In this manner, the quantity of cut food or fruit or vegetables that has been collected in the container can be seen from the outside. This creates a filling-level display in a very simple manner. The collecting container in this case can be made of plastic or glass.

As an alternative, the collecting container can also be made of metal, especially of aluminum and/or stainless steel.

Preferably, the bottom of the collecting container has a base. This ensures that the multi-functional device stands securely.

DESCRIPTION OF THE DRAWINGS

Additional objectives, advantages, features and application possibilities of the present invention ensue from the description below of an embodiment making reference to the drawings. In this context, all of the described and/or depicted features either on their own or in any meaningful combination constitute the subject matter of the present application, also irrespective of the way they are compiled in the claims or of the claims to which they refer back.

The following is shown.

DETAILED DESCRIPTION OF EMBODIMENTS

Figure 1:
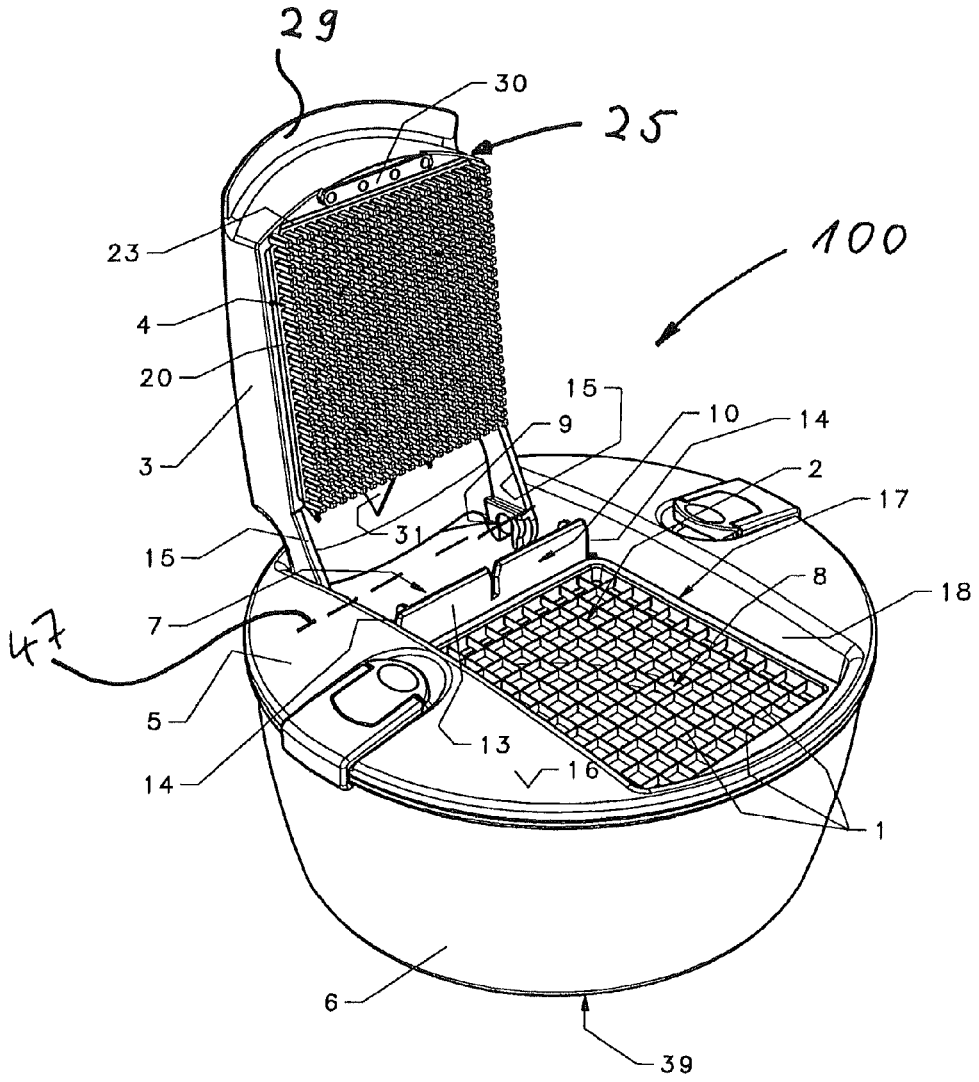
FIG. 1—a possible embodiment of a device for cutting food, with the actuating part open, in a perspective view.
Figure 2:
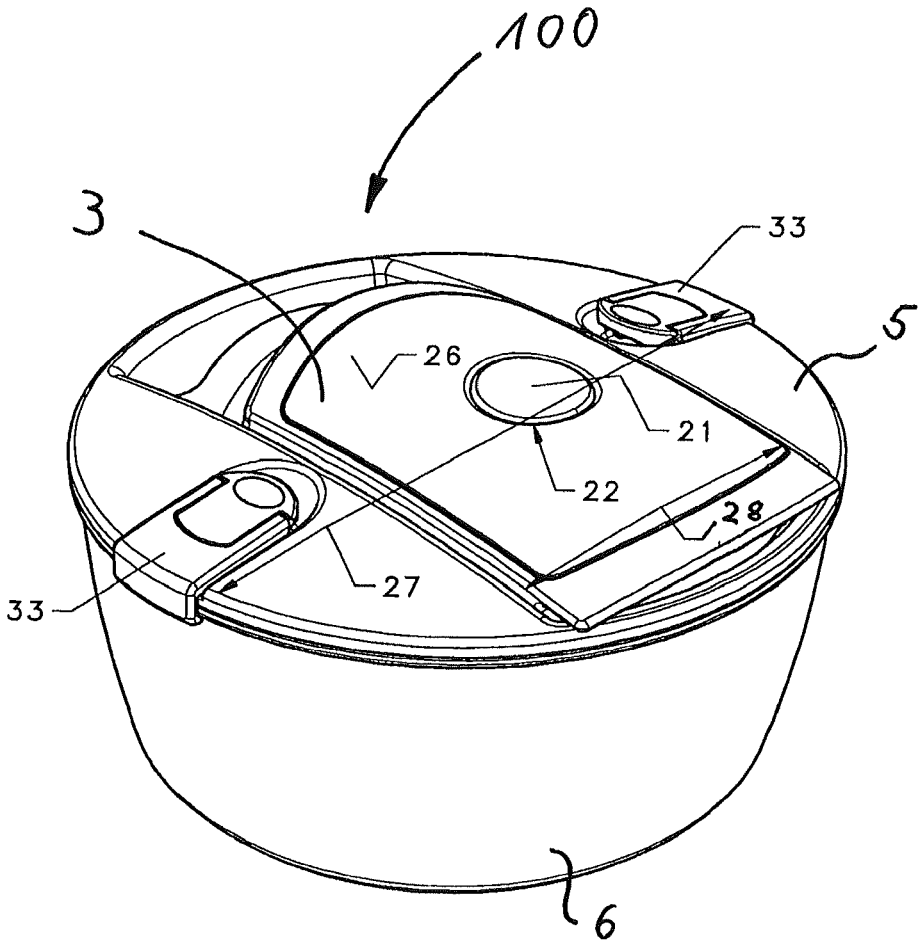
FIG. 2—the cutting device according to FIG. 1, with the actuating part closed, in a perspective view.
Figure 3:
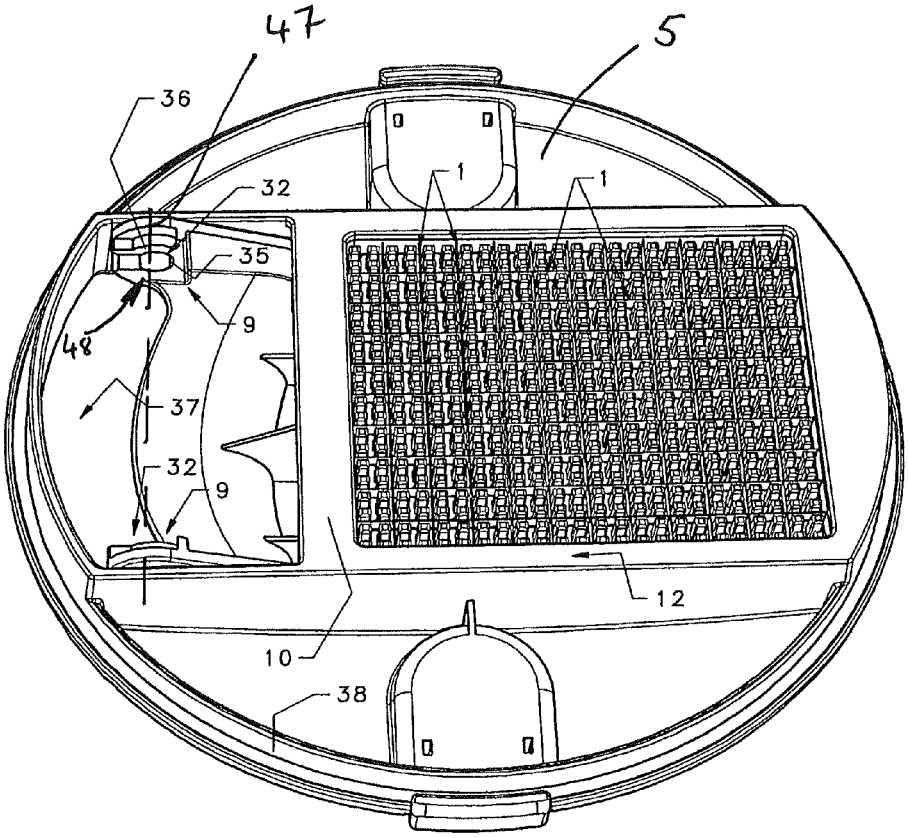
FIG. 3—the lid part of the cutting device according to FIG. 1, in a view from below.

FIGS. 1 to 6 show a schematic depiction of a possible embodiment of a device 100 for cutting food such as fruit and vegetables. The device 100 is particularly well-suited for cutting hard types of fruit and vegetables such as, for example, potatoes, carrots and onions. The device 100 can also be used to cut soft types of food such as, for instance, lettuce leaves or spinach leaves.

The device 100 can be operated manually and, for this purpose, has an actuating part 3 that is pressed against a cutting part 2 of the cutting device 100, said cutting part 2 having multiple blades 1.

Preferably, the cutting part 2 and the actuating part 3 are mounted so that they can pivot counter to each other, so that the food is cut according to the so-called pivoting principle, in which, in the present embodiment of the device 100, the actuating part 3 is pivoted counter to the cutting part 2. The cutting part 2 is integrated into a lid part 5, in particular, it is formed by the lid part 5. The lid part 5 serves to affix the cutting device 100 onto a collecting container 6 for the cut food.

As can be seen especially in FIG. 1, the lid part 5 has an opening 7 that forms a passage 8 into the collecting container 6 for the cut food and in which the bearing 9 or pivot bearing of the actuating part 3 is accommodated. Here, the pivot axis 47 of the pivot bearing 9 is arranged so as to be recessed with respect to the top 16 of the lid part 5.

In order to reinforce or stiffen the lid part 5 or the cutting part 2 in the vicinity of the opening 7, a reinforcement part 10 is provided that at least partially spans the opening 7. The reinforcement part 10 here is preferably arranged between the bearing 9 for the actuating part 3 and the passage 8 for the cut food.

The reinforcement part 10 can be formed as a section of the lid part 5 or of the cutting part 2, in particular, it can be shaped onto it. The reinforcement part 10 can also be a separate component that is mounted on the lid part 5 or on the cutting part 2. The reinforcement part 10 has a web section 13 that is preferably raised in the direction of the actuating part 3. The web section 13 has lateral insertion slits 14 into each of which a side wall 15 of the actuating part 3 is lowered during the pivoting motion.

Blades 1 that are offset with respect to the top 16 of the lid part 5 in the direction of the collecting container 6 are arranged inside the opening 7. The blades 1 here are limited by the reinforcement part 10 from moving in the direction of the bearing 9. Consequently, the reinforcement part 10 also serves to limit the movement of the blades 1.

The opening 7 of the lid part 5 or of the cutting part 2 is also at least partially surrounded by side walls 18 that form a depression 17. The depression 17 or its side walls 18 then create a support 12 for a blade frame 19 that holds the blades 1. The blade frame 19 preferably lies loose in the depression 17 on the support 12. Here, preferably part of the support 12 is formed by the reinforcement part. The blade frame 19 can also be arranged detachably inside the depression 17.

The blades 1, which may include a first blade 1*a* and a second blade 1*b*, are preferably configured as a cutting grid 49, whereby the blades 1 can be present in various arrangements with respect to each other. The blades 1 can be arranged, for example, parallel to each other, so that the food to be cut is cut in slices through such a cutting grid 49. The blades can also be arranged so as to intersect each other, so that the resultant cutting grid 49 cuts the food into cubes. Moreover, the blades can also be arranged in such a way that they intersect each other at a single point, thus allowing the food to be cut, for example, into wedges. In this context, the blades are preferably in the form of knives. Naturally, the blades can also be implemented in the form of wires.

In the cutting device 100 according to FIGS. 1 to 6, the actuating part 3 is mounted on or configured by the opening 70 or by the depression 17 in such a way that the actuating part 3 is essentially lowered into the opening 7 of the lid part 5 when the actuating part 3 is pivoted. In the closed position, the actuating part 3 is preferably essentially recessed into the opening 7 or into the depression 17, so that an essentially smooth surface is formed when the actuating part 3 is in the closed position of the cutting device 100.

With the cutting device 100 according to FIGS. 1 to 6, the actuating part 3 has a plunger plate 4 that presses the food to be cut through the cutting part 2 during the cutting procedure. For this purpose, the plunger plate 4 has indentations 20 that correspond to the blades 1. In order to ensure that the food is cut all the way through, the clear depth of the indentations 20 is greater than the height of the blades 1. As a result, the plunger plate 4 extends beyond the blades 1 in the folded position of the actuating part 3.

Figure 6:
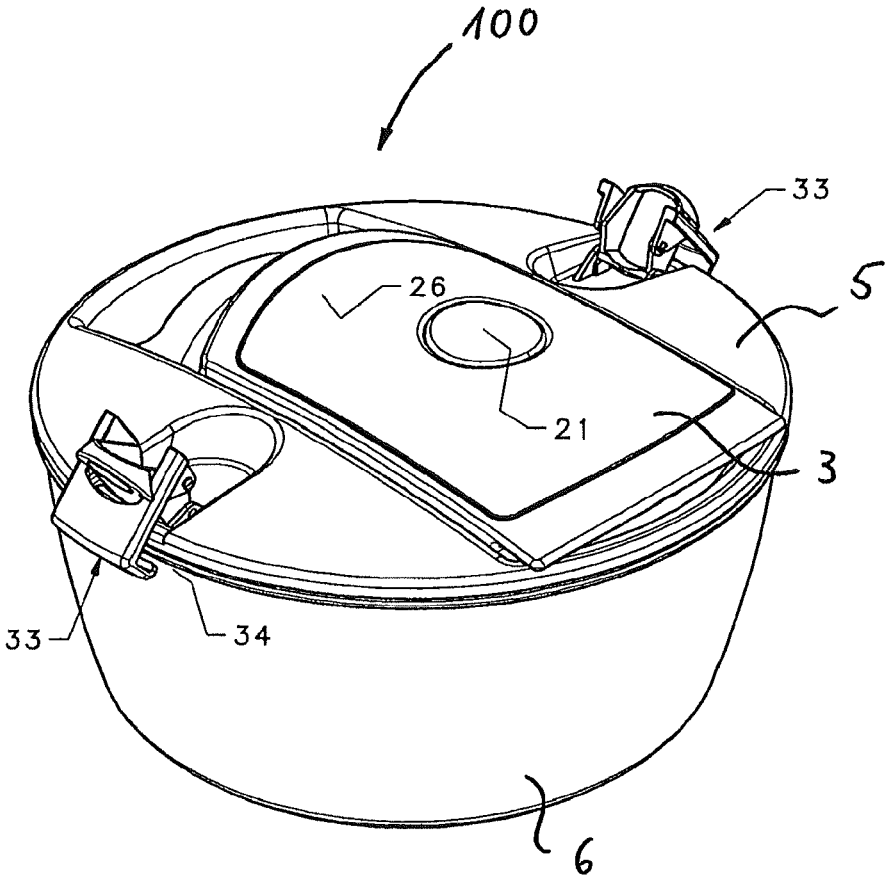
FIG. 6—the cutting device according to FIG. 1, in another perspective view.

In order for the actuating part 3 to be returned from this folded position into the open position, a gripping section 29 that extends beyond the opening 7 in the folded position of the actuating part 3 is arranged on the free end of the actuating part 3, as this is illustrated especially in FIG. 6.

A damping section 30 is arranged on the actuating part 3 on the side with the plunger plate 4. The damping section 30 is preferably made of an elastic material such as, for instance, rubber, and it serves as a damping element or as a so-called stopper for the actuating part 3 at the end of the cutting procedure. The actuating part 3 then comes to rest with its damping section 30 on the top of the blade frame 19. In particular, the damping section 30 serves to prevent rattling noises of the actuating part 3 against the blade frame 19, for example, when the cutting device 100 is being carried.

The actuating part 3 also has at least one reinforcement section 31 that is intended to stiffen or reinforce the actuating part 3 so that it cannot bend in the direction of its longitudinal axis.

The actuating part 3 has a manually actuatable mechanism 22 by means of which at least one cleaning part 23 can be moved along the plunger plate 4. In order to achieve this, the cleaning part 23 is preferably configured as a grid that corresponds to the indentations 20 of the plunger plate 4 of the actuating part 3. When the mechanism 22 is actuated, the cleaning part 23 is moved from its initial position 25 towards the free end of the plunger plate 4 all the way to an end position 24. For this purpose, an actuating element 21 is provided which, upon actuation, moves the cleaning part 23 counter to the force of at least one spring element (not shown here).

As can be seen particularly in FIG. 1, when the cleaning part 23 is in its initial position 25, it is in a retracted state, preferably in the vicinity of the bottom of the indentations 20 or in the area of the plunger plate 4 which is adjacent to the actuating part 3; in particular, the plunger plate 4 is shaped onto the actuating part 3. Preferably, when the cleaning part 23 is in its initial position 25, it is in contact with the bottom of the plunger plate 4 or with the bottom of the indentations 20.

Figure 4:
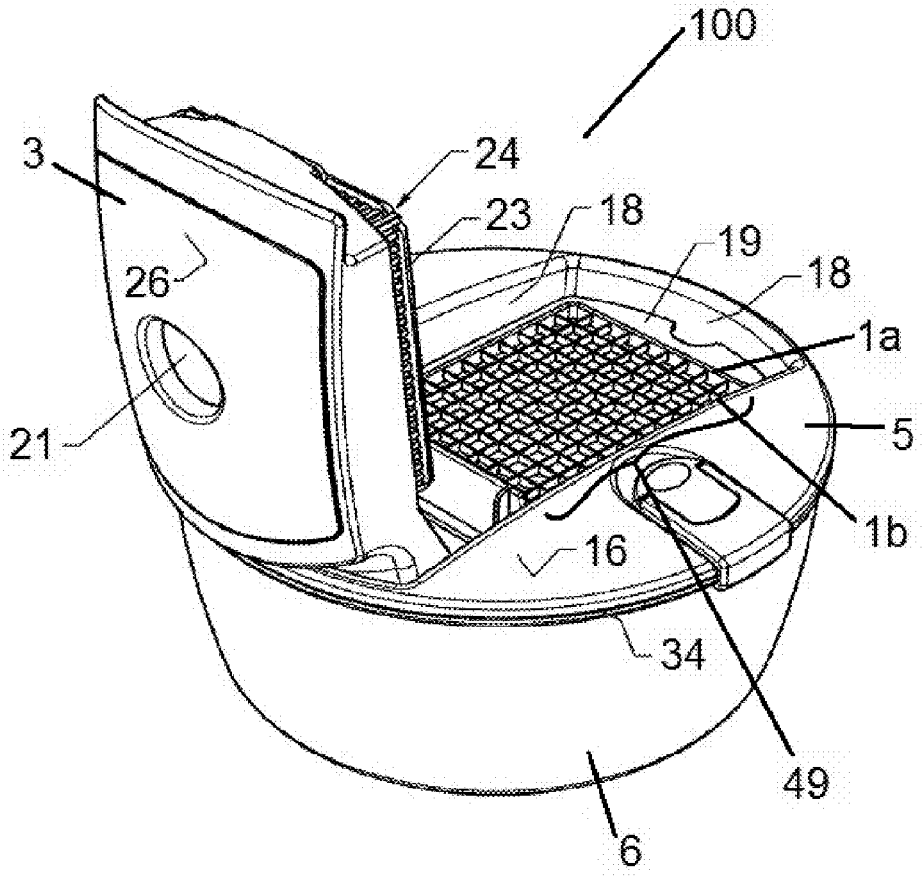
FIG. 4—the cutting device according to FIG. 1, with the actuating part open and with the cleaning part extended, in a perspective view.
Figure 5:
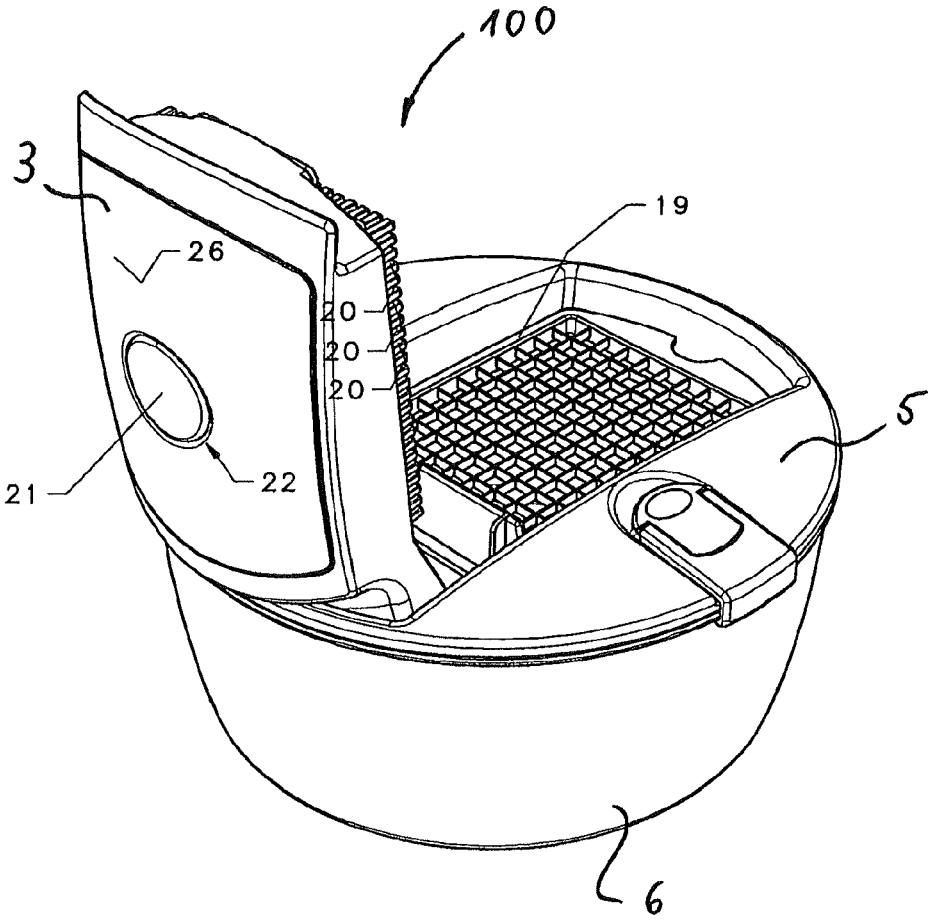
FIG. 5—a cutting device according to FIG. 1, with the actuating part open and with the cleaning part in the initial position, in a perspective view.

In the end position 24, the cleaning part 23 is in the vicinity of the free end of the plunger plate 4, as can be seen especially in FIG. 4. Here, the free end of the plunger plate 4 is preferably the end that is facing the cutting part 2 during the course of the pivoting motion. In the end position 24, the cleaning part 23 is preferably at the free end of the plunger plate 4 and can also extend slightly beyond the free end.

After the actuation, the cleaning part 23 automatically returns to its initial position 25. The return movement of the cleaning part 23 is effectuated by the pre-tensioned spring elements that pull the cleaning part 23 back into its initial position 25 after the actuating element 21 has been released.

The mechanism 22 can preferably be operated from the top 26 of the pivotable actuating part 3. For this purpose, the actuating element 21 is preferably arranged on the top 26. The actuating element 21 is arranged so as to be recessed in the top 26 of the actuating part 3, and it is pressed towards the interior of the actuating part 3 after the actuation, as can be seen especially in FIG. 4.

The actuating part 3 is preferably arranged detachably on the cutting part 2 or on the lid part 5, preferably detachably by means of laterally installed hinges 32. The hinges 32 are formed by pivot pins 35 that each project inwards laterally on the side wall 18 of the lid part 5 or of the cutting part 2, said pivot pin 35 being accommodated in a receptacle 48 of the actuating part 3. Preferably, the receptacle 48 is configured in the form of a section 36 that at least partially surrounds the pivot pin 35. The section 36 on the actuating part 3 has an opening that is arranged in such a way that, when the actuating part 3 is in a pivoting position of more than 90° starting from the folded position, it can be removed from the pivot pin 35.

In the area of the bearing 9, the top 16 of the lid part 5 has a cutout 37 that extends over the opening 17, whereby said cutout 37 can be employed, for instance, as a gripping part for the lid part 5.

In the cutting device 100 according to FIGS. 1 to 6, the lid part 5 is configured to be circular and preferably has a diameter 27 that is essentially twice as large as the width 28 of the actuating part 3. The lid part 5 here is detachably secured on the collecting container 6 by means of at least two clasping elements 33. The clasping elements 33 are supported against a collar 34 on the rim along the opening of the collecting container 6, as a result of which the collecting container 6 is firmly joined to the lid part 5 when the clasping elements 33 are tensioned.

The collecting container 6 can be a component of the cutting device 100. Here as well, the cutting device 100 can be combined with any other desired collecting container such as, for example, bowls that are normally found in kitchens. The collecting container 6 is preferably configured to be transparent and is made of plastic or glass. The front face of the rim along the opening of the collecting container 6 is in contact with at least sections of the lid part 5. Preferably, the bottom of the collecting container forms a base 39 for placement onto the working surface, for instance, a kitchen counter. The opening of the collecting container 6 is arranged essentially opposite from the bottom.

The lid part 5 also has a collar 38 that projects towards the lid and that is at least partially surrounded by the rim along the opening of the collecting container 6. As a result, the rim along the opening of the collecting container 6 can be aligned with the lid part 5.

The cutting device 100 with its lid part 5 allows its use in a multi-functional kitchen device in which a collecting container 6, for example, in the form of a bowl, can be combined as desired with a lid part of the cutting device 100 or with the lid part of a different implement for processing fruit and vegetables. In this context, the multi-functional device makes it possible to process larger quantities of fruit and vegetables, particularly in view of its relatively large collecting container. For instance, with this multi-functional device, it is possible for an additional attachment to be a lid part with a salad spinner. In this case, the multi-functional device functions in a first step as a salad spinner and serves to dry the washed lettuce and, in a second step, can then be used in combination with the cutting device 100 for purposes of cutting the lettuce.

Figure 7:
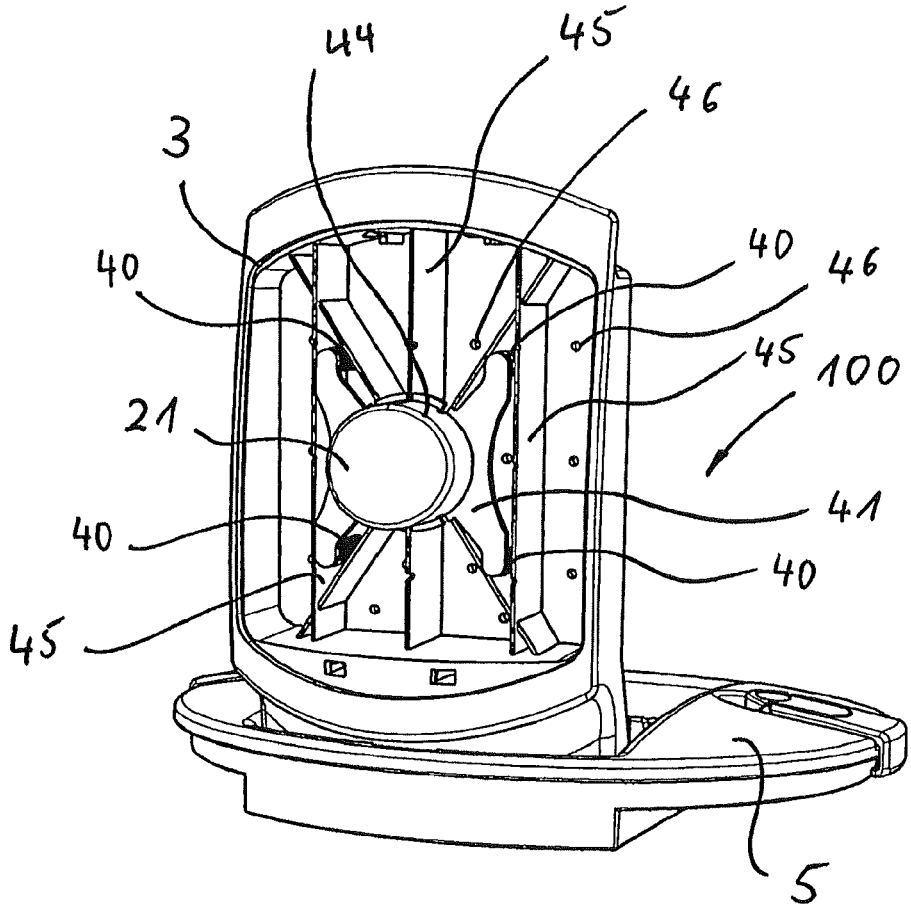
FIG. 7—a possible embodiment of an actuating mechanism for sliding a cleaning part on an actuating part of a cutting device according to FIG. 1, in a perspective view.
Figure 8:
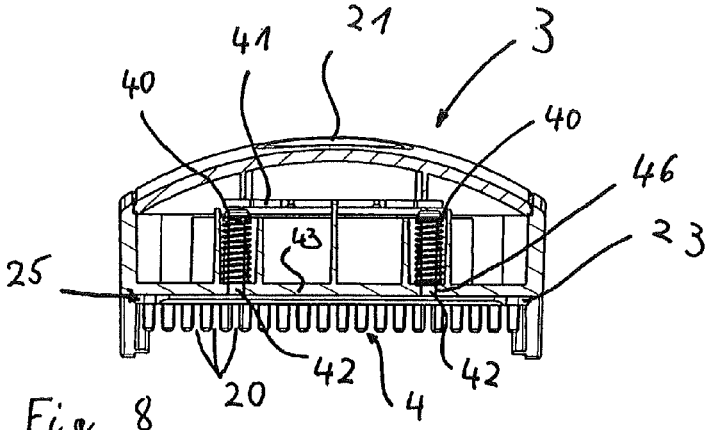
FIG. 8—the actuating part with the actuating mechanism for the cleaning element according to FIG. 7, in a cross-sectional view.
Figure 9:
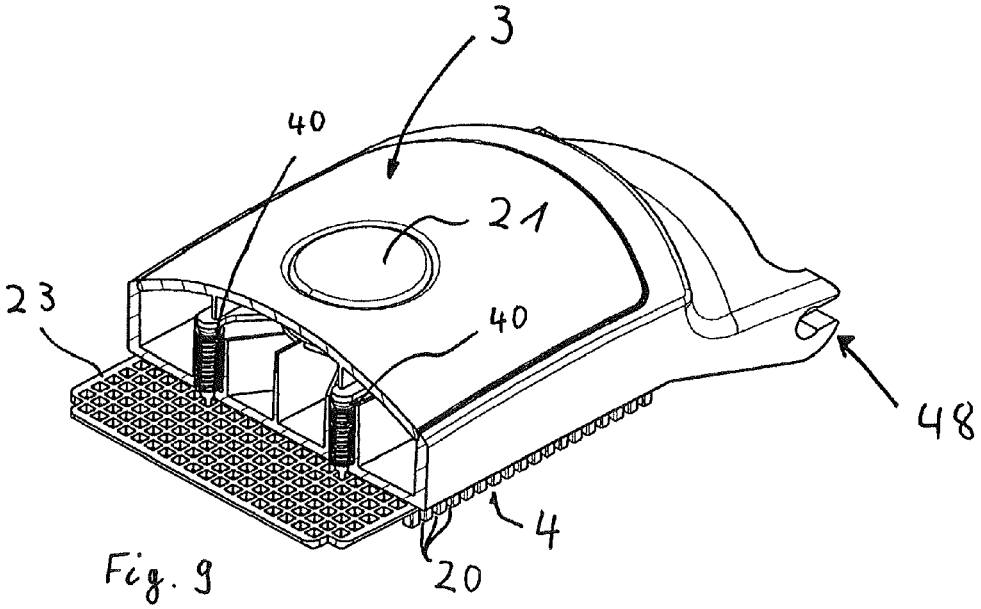
FIG. 9—the actuating part according to FIG. 7, in a partial sectional perspective view.

FIGS. 7 to 9 show a schematic depiction of a possible embodiment of the manually actuatable mechanism 22 on the basis of an example of the actuating part 3 of the cutting device 100 according to FIGS. 1 to 6. Components of the actuating mechanism 22 according to FIGS. 7 to 9 that are identical or functionally equivalent to the components of the cutting device 100 according to FIGS. 1 to 6 are designated with the same reference numerals; in this context, reference is hereby made to the description of FIGS. 1 to 6.

The actuating element 21 is coupled to a preferably plate-shaped pressure part 41 by means of which the actuating force exerted via the actuating element 21 is transmitted to the cleaning part 23 via several pressure elements that are distributed over the surface of the cleaning part 23 and that act upon it. As a result, the sliding movement of the cleaning part 23 is ensured without tilted or tipped areas. The pressure elements 42 are preferably configured in the form of a pin element. Preferably, there are four pressure elements 42 that are connected, preferably permanently connected, to the cleaning part 23 and that preferably extend into the actuating part 3. Preferably, the cleaning part 23 and the pressure elements 42 are permanently connected to each other, whereby preferably there is a permanent connection between the pressure elements 42 and the pressure part 41, and preferably the actuating element 21 is permanently connected to the pressure part 41. As a consequence, the actuating element 21 and the cleaning part 23 are secured to each other so that they cannot fall off.

In order for the cleaning part 23 to automatically return to the initial position 25 from its end position 24 following actuation, preferably four spring elements 40 are provided. The spring elements 40 are preferably configured as pressure springs that are preferably slid onto the appertaining pressure element 42. One end of the spring elements 40 is supported, on the one hand, on a housing section 43 of the actuating part 3 that is preferably adjacent to the plunger plate 4. On the other hand, the other end of the spring elements 40 is supported on the pressure part 41 or on an intermediate element that is in operational contact with the pressure part. When the pressure part 41 executes a sliding movement, the pressure elements 42 are pushed outwards via holes or passages 46 in the housing section 43, a process in which the cleaning part 23 is moved from its initial position 25 in the direction of its end position 24 counter to the pressure of the spring elements 40, whereby the spring elements 40 are compressed in the process.

The actuating element 21 is secured and installed in an appropriate housing 44. Preferably, web-like reinforcement elements 45 are provided for purposes of reinforcing the actuating part 3. The reinforcement elements 45 are preferably permanently joined to the housing 44 for the actuating element 21.

While preferred embodiments of the invention have been described and illustrated here, various changes, substitutions and modifications to the described embodiments will become apparent to those of ordinary skill in the art without thereby departing from the scope and spirit of the invention.

LIST OF REFERENCE NUMERALS

100 device, cutting device
1 blades
2 cutting part
3 actuation or actuating part
4 plunger plate
5 lid part
6 collecting container
7 opening
8 passage
9 bearing, pivot bearing
10 reinforcement part
12 support
13 web section
14 insertion slit
15 side wall
16 top
17 depression
18 side wall
19 frame, blade frame
20 indentations
21 actuating element
22 mechanism
23 cleaning part
24 end position
25 initial position
26 top
27 diameter
28 width
29 gripping section
30 damping section
31 reinforcement section
32 hinge
33 clasping elements
34 collar
35 pivot pin
36 section
37 cutout
38 collar
39 base
40 spring element
41 pressure part
42 pressure element, pin element
43 housing section
44 housing
45 reinforcement element
46 hole, passage
47 pivot axis
48 receptacle

The invention claimed is:

1. A device for cutting food such as fruit and vegetables, the device comprising:

a cutting part having several blades, the several blades including at least a first blade and a second blade that intersect each other so as to form a cutting grid;

an actuating part, said cutting part and actuating part being mounted so that they can pivot counter to each other by a pivot bearing and wherein the actuating part is pressed against the cutting part in order to cut the food to be cut;

a lid that is adapted to be detachably affixed onto a collecting container for cut food, the lid including an opening with a passage for the cut food; and means adapted to reinforce the lid in the vicinity of the opening, wherein the reinforcing means are formed by at least one reinforcement part that at least partially spans the opening, wherein the cutting grid and the pivot bearing are both accommodated in the opening such that a pivot axis of the pivot bearing and the cutting grid are recessed with respect to a top of the lid;

wherein the actuating part has a width and the lid has a width, the width of the lid being about 1.5 to 3.5 times the width of the actuating part, and wherein the reinforcement part has a raised web section preferably with lateral insertion slits into each of which a side wall of the actuating part is lowered during a pivoting motion.

2. The device according to claim 1, wherein the pivot bearing is arranged on at least one side wall adjacent to the opening.

3. The device according to claim 1, wherein the pivot bearing is formed by at least one hinge with a pivot pin arranged on the at least one side wall of the opening and by a receptacle arranged on the actuating part.

4. The device according to claim 1, wherein the reinforcement part is arranged between the pivot bearing and the passage for the cut food.

5. The device according to claim 1, wherein the reinforcement part is configured as a limiter against a movement of the blades in the direction of the pivot bearing.

6. The device according to claim 1, wherein the reinforcement means are formed by the side walls of the lid which form a depression and which at least partially surround the opening.

7. The device according to claim 1, wherein the actuating part is substantially lowered into the opening of the lid when the actuating part is pivotably pressed against the cutting part.

8. The device according to claim 1, wherein, in the closed position, the actuating part is substantially lowered into the opening.

9. The device according to claim 1, wherein the blades are arranged with respect to the top of the lid so as to be recessed towards the interior of the collecting container.

10. The device according to claim 1, wherein the cutting part is formed by the lid, and wherein the blades are secured in a detachable frame arranged on the cutting part.

11. The device according to claim 10, wherein a depression forms a contact surface for the detachable frame.

12. The device according to claim 1, wherein the cutting part and the actuating part are detachably connected to each other.

13. The device according to claim 1, wherein the lid is configured to be essentially circular.

14. A multifunctional kitchen device, comprising:

the device of claim 1; and a collecting container for the cut food.

15. The multifunctional device according to claim 14, further comprising an additional implement for processing the cut food that includes a lid part that is adapted to be placed onto the collecting container alternatively to the device.

16. The multifunctional device according to claim 14, wherein the lid part is detachably secured on the collecting container.

17. The multifunctional device according to claim 14, wherein the collecting container has an opening and a rim along the opening that includes a front face that makes contact with at least sections of the lid.

18. The multifunctional device according to claim 17, wherein the rim along the opening of the collecting container at least partially encompasses a collar of the lid that projects interior of the collecting container.

19. The multifunctional device according to claim 14, wherein the collecting container is formed of a transparent material.

20. The multifunctional device according to claim 14, wherein the bottom of the collecting container forms a base for the multifunctional device.

21. A device for cutting food such as fruit and vegetables, the device comprising:

a cutting part having several blades, the several blades including at least a first blade and a second blade that intersect each other so as to form a cutting grid, an actuating part, said cutting part and actuating part being mounted so that they can pivot counter to each other by a pivot bearing, and wherein the actuating part is pressed against the cutting part in order to cut the food to be cut, and a lid that is adapted to be detachably affixed onto a collecting container for the cut food, the lid including an opening with a passage for the cut food, wherein the pivot bearing is accommodated in the opening;

wherein the device has reinforcement means adapted to reinforce the lid in the vicinity of the opening, wherein the reinforcement means are formed by at least one reinforcement part that at least partially spans the opening; and wherein the reinforcement part has a raised web section preferably with lateral insertion slits into each of which a side wall of the actuating part is lowered during the pivoting motion.

* * * * *